US007172095B2

(12) United States Patent
Marshall

(10) Patent No.: US 7,172,095 B2
(45) Date of Patent: Feb. 6, 2007

(54) BOTTLE CLOSURE CONTAINING BEVERAGE CONCENTRATE

(76) Inventor: Christopher John Marshall, 16532 Wikiup Rd., Ramona, CA (US) 92065

( * ) Notice: Subject to any disclaimer, the term of this patent is extended or adjusted under 35 U.S.C. 154(b) by 551 days.

(21) Appl. No.: 10/418,931

(22) Filed: Apr. 18, 2003

(65) Prior Publication Data

US 2004/0208960 A1 Oct. 21, 2004

(51) Int. Cl.
*B67D 5/00* (2006.01)
*B65D 25/08* (2006.01)

(52) U.S. Cl. ..... 222/83; 206/219; 222/129; 222/145.1; 222/525; 426/115

(58) Field of Classification Search ..... 206/219–222, 206/568; 215/6, 10, DIG. 8; 222/83, 129, 222/145.1, 145.5, 145.6, 153.07, 525, 630; 426/66, 77, 112, 115
See application file for complete search history.

(56) References Cited

U.S. PATENT DOCUMENTS 3,657,994 A 4/1972 Post
3,924,741 A 12/1975 Kachur et al.
4,024,952 A 5/1977 Leitz
4,221,291 A 9/1980 Hunt
4,264,007 A 4/1981 Hunt
4,314,656 A 2/1982 Kessler
4,502,604 A 3/1985 Martus
4,927,065 A 5/1990 Beck
4,979,648 A 12/1990 Montgomery et al.
5,104,008 A * 4/1992 Crisci ..... 222/525
5,246,142 A 9/1993 DiPalma et al.
5,472,120 A 12/1995 Stebick et al.
5,772,017 A 12/1998 Kang
5,988,448 A * 11/1999 Foth ..... 222/525
6,076,570 A 6/2000 Byrne
6,098,795 A 8/2000 Mollstam et al.
6,170,654 B1 * 1/2001 Gartner et al. ..... 206/219
6,250,346 B1 6/2001 Castillo
6,372,270 B1 4/2002 Denny
6,412,526 B2 7/2002 Castillo
6,477,743 B1 * 11/2002 Gross et al. ..... 222/83
6,702,161 B2 * 3/2004 Adams et al. ..... 222/83
6,854,595 B2 * 2/2005 Kiser ..... 206/219

* cited by examiner

*Primary Examiner*—Luan K. Bui
(74) *Attorney, Agent, or Firm*—Mark Snyder

(57) ABSTRACT

The present invention relates to controlled flow re-sealable bottle closures containing a beverage concentrate for use in mixing flavored water-based beverages at or near the point of consumption by activation of a mixing mechanism allowing the contents of the bottle to co-mingle with the beverage concentrate.

15 Claims, 10 Drawing Sheets

BOTTLE CLOSURE CONTAINING BEVERAGE CONCENTRATE

FIELD OF THE INVENTION

The present invention relates to re-sealable bottle closures for use with bottled beverages. In particular, the present invention relates to re-sealable beverage bottle closures that contain at least one beverage concentrate for use by consumers in mixing with the contents of the bottle.

BACKGROUND OF THE INVENTION

The popularity of bottled drinking water as an alternative to tap water has been growing in recent years. In fact, bottled water, which includes spring water, distilled water, purified water, mineral water, and others, can be found in nearly every country in the world today. Although water itself is a popular beverage, many consumers prefer flavored water-based beverages, such as those sold under the popular trademarks KOOL-AID® and GATORADE®. Indeed, some flavored water-based drinks may enhance the body's absorption of vitamins, minerals, and other substances, as well as increase the body's rate of hydration.

One problem encountered by flavored beverage consumers has been the availability of their favorite beverage at or near the desired point of consumption. For example, the choice of available flavored beverages from vendors is often limited when visiting popular tourist attractions. Such vendors desire to maximize sales with as small a product inventory and selection as possible. Reduced product inventory and selection also reduces the risk that a product will not sell before it's shelf life has been exceeded.

One method of overcoming the problem of the limited selection and availability of flavored water-based beverages at or near the point of consumption is for the consumer to carry the desired beverage on his person. The obvious problem with this approach is that it can often be cumbersome, or burdensome to carry one or more containers of liquid. For example, it may be difficult for a mother or father to carry multiple beverage containers to a remote point of consumption for a family having different beverage preferences.

Another method of overcoming the problem of the limited selection and availability of flavored water-based beverages at or near the point of consumption is for the consumer to carry the desired beverage drink mix on his person, for mixing with bottled water available at the point of consumption. The large number of producers of bottled water products, and their popularity among consumers, has ensured that bottled water is often available as an alternative to the most popular flavored beverages. As before, one problem with this approach is that it can often be cumbersome, or burdensome to carry one or more large containers of drink mix. Another problem with this approach is that it is difficult to measure and mix such drink mixes at the point of consumption using water sold in bottles. Suitable mixing containers increase the load that must be carried to the point of consumption. Mixing within the water bottle itself is often impractical due to the need to accurately measure and deposit the drink mix through the relatively narrow neck of the water bottle.

As a result of the inadequacies of the existing solutions to these problems, there is a need to provide increased availability of flavored water-based beverages at the point of consumption. There is a need to provide easy-to-use, point of consumption, mechanism for measuring of flavored, water-based drink mixes. There is a need to provide easy-to-use, point of consumption, mechanism for mixing of flavored, water-based drink mixes. There is a need to provide a point of consumption mechanism that incorporates all of the above, and further contains closure features that allow the consumer to control the flow of the beverage from the beverage container.

SUMMARY OF THE INVENTION

It is an object of the present invention to provide consumers with an easy-to use apparatus for mixing flavored water-based beverages on demand, at or near the point of consumption.

It is an object of the present invention to provide an apparatus containing a pre-measured amount of beverage concentrate for use by a consumer in mixing a flavored water-based beverages at or near the point of consumption.

It is an object of the present invention to provide an apparatus for mixing flavored water-based beverages at or near the point of consumption that is contained within the beverage container, and does not require the consumer to come into contact with the beverage contents or beverage concentrate during mixing.

It is an object of the present invention to provide an apparatus for mixing flavored water-based beverages at or near the point of consumption that contains dispensing features that allow controlled flow of the mixed beverage.

It is an object of the present invention to provide an apparatus for mixing flavored water-based beverages at or near the point of consumption that is lightweight and of compact design, allowing the user to carry numerous such items without significant burden.

It is an object of the present invention to provide an apparatus for mixing flavored water-based beverages at or near the point of consumption that contains all of the above advantages, and which is simple to manufacture.

The present invention includes a re-sealable, controlled flow bottle closure comprised of a threaded shell having a throat portion and a container connector portion, with the throat portion having an elongate wall connected at one end to the container connector portion. The throat portion of the threaded shell includes an interior space and a mixing aperture that extends through the wall and into the interior space.

The bottle closures of the present invention further include a beverage concentrate reservoir having a mixing mechanism, which is at least partially inserted into the interior space of the throat portion previously described. The beverage concentrate reservoir is comprised of a tubular reservoir section that contains a beverage concentrate, as well as an aperture that allows flow of liquid in the beverage container to co-mingle with the beverage concentrate when the mixing mechanism is activated and the aperture in the beverage concentrate reservoir and the aperture in the throat portion are at least partially aligned. The alignment of the apertures can be achieved through a number of means. Such means include, but are not limited to, snap-fit mechanisms, rotational mechanisms, screw-type mechanisms, and combinations thereof.

The bottle closures of the present invention further include features to allow consumers of a beverage to both re-seal the beverage bottle and to control the flow of the beverage from the bottle. In this regard, the bottle closures of the present invention include a cap-and-stem assembly that allows the closure to be repeatedly opened and re-sealed by a consumer. The cap-and-stem assembly also serves as a valve to allow the consumer to control the amount of flow of liquid for consumption from the beverage container by adjustment of the cap relative to the stem.

The present invention also includes methods for use of the bottle closures of the present invention. Such methods include the steps of engaging the bottle closures as taught herein with a beverage bottle, activation of the mixing mechanism to allow the beverage concentrate to co-mingle with liquid in the bottle to created a mixed beverage, and adjusting the cap of the cap-and-stem assembly to allow the mixed beverage to controllably flow from the beverage bottle.

The foregoing summary of the invention and further embodiments of the present invention can be better understood by reference to the following drawings and detailed description.

DETAILED DESCRIPTION

Figure 1:
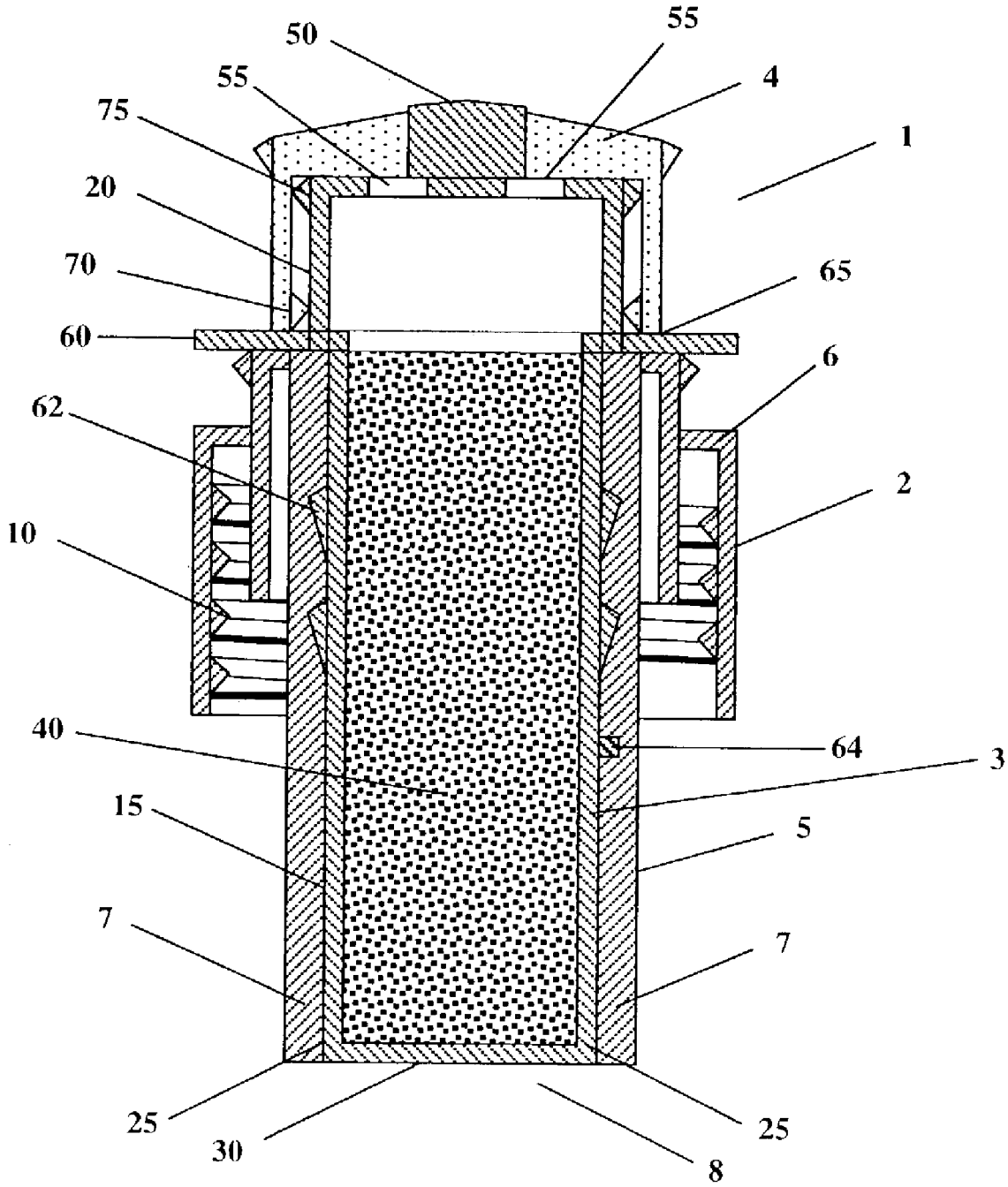
FIG. 1 is a cross-sectional view of one embodiment of the re-sealable bottle closures of the present invention.

As described more fully below, the present invention is directed toward re-sealable bottle closures for use with bottled beverages. More specifically, the present invention relates to re-sealable, controlled flow bottle closures containing a beverage concentrate reservoir that can be activated by a consumer of the bottled beverage at the point of consumption to mix the concentrate with the bottle contents to create a mixed beverage.

As used herein, the term "bottle" refers to any beverage container made of plastic, glass, metal or other material that contains a threaded top designed for use with a threaded or snap-fit closure. Such beverage containers are well known in the beverage industry. There are an almost unlimited number of product configurations and sizes. The term "bottle" as used herein is not intended to be limited to any particular container size, configuration, or material composition.

As used herein, the phrase "bottled beverage" refers to any beverage contained in a bottle of the present invention as defined previously herein. Such bottled beverages can include water, including without limitation, tap water, purified water, distilled water, spring water, mineral water, de-ionized water, or carbonated water.

As used herein, the phrase "bottle closure" refers generically to a closure for containers such as the bottles of the present invention as described previously herein. Such bottle closures include without limitation, threaded closures, and re-sealable bottle closures. Such bottle closures need not, however, be threaded closures, and in some embodiments can be "snap-fit" type closures.

As used herein, the phrase "re-sealable closure" refers generically to a specific class of bottle closures as previously defined. In general such closures include a cap having an aperture that fits around and corresponds in shape to a central stem extending from the closure. The stem and/or support structure for the stem contain passageways for fluid to escape from the bottle when the cap is placed in its "open" position, as more fully described below. The cap can be axially adjustable relative to the stem using a variety of mechanisms such as by pushing or pulling the cap, or by screw action relative to the central stem. When the cap is seated snugly to the stem, and the stem extends through the aperture on the cap, it is in its closed position, and the bottle is sealed. When the cap is unseated, and moved axially relative to the stem, such that the stem does not extend through the aperture on the cap, it is in its open position, and fluid is capable of flowing out of the bottle. In this regard, the cap and stem act as a valve for controlling flow from the bottle. By adjusting the positioning of the cap axially relative to the stem, the fluid flow from the bottle can be controlled as desired by the user. The re-sealable closures of the present invention include this controlled dispensing feature.

The re-sealable closures of the present invention include a beverage concentrate reservoir. The beverage concentrate reservoir is a cavity within the bottle closure that contains the beverage concentrate within the bottle closure until it is exposed by the consumer for mixing with the bottle contents, typically at or near the point of consumption. Preferably, the beverage concentrate is pre-measured for use with a specific volume of liquid, such as water. In this manner, the re-sealable closure can be fitted to a bottle of water containing an appropriate amount of water to be mixed with an appropriate amount of beverage concentrate.

The re-sealable closures of the present invention include at least one beverage concentrate for use by a consumer of a bottled beverage in mixing with the contents of the bottled beverage. As used herein, the phrase "beverage concentrate" refers to a concentrate of a beverage mixture that is at least semi-soluble in a bottled beverage of the present invention as described herein. Such beverage concentrates can be in liquid form, solid form, or mixtures thereof. Liquid form beverage concentrates include without limitation, syrups. Solid form beverage concentrates include, without limitation, powdered mixes, granulated mixes and the like. Many such beverage concentrates are currently known and used in the art of beverage mixing. Such beverage concentrates include, without limitation, popular powdered beverage concentrates sold under trademarks KOOL-AID®, TANG®, and GATORADE®. Additional such beverage concentrates include powdered beverage concentrates for coffee, juices, teas, and infant formula. Beverage concentrates of the present invention can also include preparations of nutritional supplements, such as vitamins and the like. Beverage concentrates of the present invention can also include preparations of orally-ingestible medications. Beverage concentrates of the present invention can also include alcohol-based drinks. It is to be expressly understood that the beverage concentrates of the present invention must contain at least one of the above types of components, but can also include any combination or mixtures thereof.

One of the benefits of the bottle closures of the present invention is the provision of a mechanism that allows a consumer to mix the beverage concentrate with the bottle contents by activation of a mixing mechanism incorporated in the bottle closure, and then dispense the mixed beverage in a controlled fashion. Activation of the mixing mechanism may occur by screw action, twisting action, pushing action, and combinations thereof, on the mixing mechanism, as more described below with regard to the figures and specific embodiments.

The present invention will now be described in more detail with respect to the drawings. As shown in the cross-sectional view in FIG. 1, one embodiment of the present invention includes a threaded re-sealable bottle closure 1 having three components, a circular threaded shell 2, an elongate beverage concentrate reservoir 3 and a cap 4. It should be understood that the bottle closures of the present invention are generally circular in shape. Accordingly, as used in the discussion of the drawings, certain terms as used herein, such as walls or fins, should be understood to encompass a single wall or fin, having a circular shape. The shell 2 includes a generally cylindrical throat portion 5, and a threaded portion 6. The cylindrical throat portion 5 has elongate walls 7 that terminate without meeting at one end to define an open-ended, generally cylindrical space 8. Alternatively, the walls may bend at the bottom to form a partially enclosed space. The elongate walls 7 contain at least one aperture 9, as shown in FIGS. 2–8. The threaded portion 6 contains threads 10 for mating with the opposed threads of a beverage bottle (not shown). The beverage concentrate reservoir 3 includes a generally cylindrical reservoir portion 15, and a dispensing portion 20. The cylindrical reservoir portion 15 has elongate walls 25 that terminate at one end 30 to create a closed end that define a generally cylindrical cavity containing a granulated beverage mix 40. The elongate walls 25 terminate at the other end in the dispensing portion 20. As shown in FIGS. 3–5 and 7–8, the elongate walls 25 include at least one aperture 45 near the enclosed end 30 of the cylindrical reservoir portion 15, that, when properly positioned for mixing, matches up with at least a portion of the aperture(s) 9 in the cylindrical throat portion 5 of the circular threaded shell 2. The dispensing portion 20 contains a generally cylindrical stem 50 extending therefrom, having a diameter smaller than that of the cylindrical reservoir portion 15. Around the base of the stem 50 are a number of small apertures 55 to allow passage of liquid from a beverage container when the cap 4 is properly positioned. Also extending transversely from the walls of the dispensing portion 20 is a fin 60 for activation of the mixing features in certain embodiments of the present invention. The beverage concentrate reservoir 3 can be friction-fit, but preferably, as shown, is snap-fit into the throat portion 5 of the threaded shell 2. One or more retaining barb(s) 62 can be located on and extend around at least a portion of the circumference of the walls 25 of the beverage concentrate reservoir 3 to keep the beverage concentrate reservoir 3 in fixed axial position relative to the throat portion 5, which contains corresponding depression(s) 85, 86 to accept the barb(s) 62. The radial positioning of the beverage concentrate reservoir 3 can also be maintained by a protrusion 64 located on the wall 25 of the beverage concentrate reservoir 3, and which fits into a corresponding depression in the wall 7 of the throat portion of the threaded shell 2.

Figure 8:
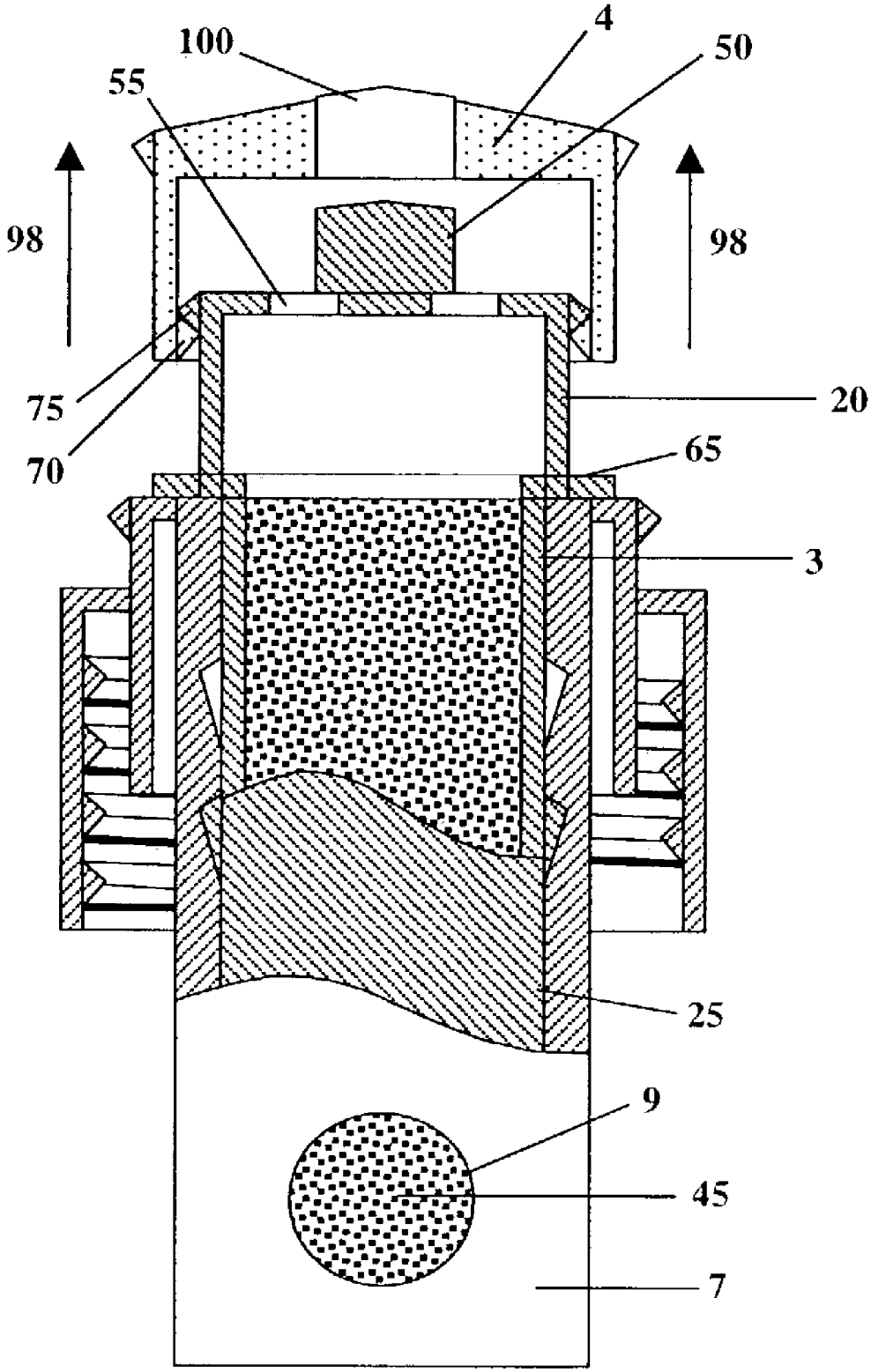
FIG. 8 is a cross-sectional, partial cut-away view of one embodiment of the bottle closures of the present invention, after opening of the dispensing features.

As shown in FIGS. 1 and 8, the re-sealable bottle closures of the present invention also include features for controlled dispensing of the beverages. A cap 4 having a central aperture 100 and which is axially adjustable about the stem 50 extending from the dispensing portion 20. The axial movement of the cap 4 relative to the stem 50 is limited in one direction by the shoulder 65 formed by the walls of the dispensing portion 20 of the beverage concentrate reservoir 3. The axial movement of the cap 4 relative to the stem 50 is limited in the other direction by the bead 70 of cap 4, and the opposed bead 75 located on the walls of the dispensing portion 20 of the beverage concentrate reservoir 3.

Figure 2:
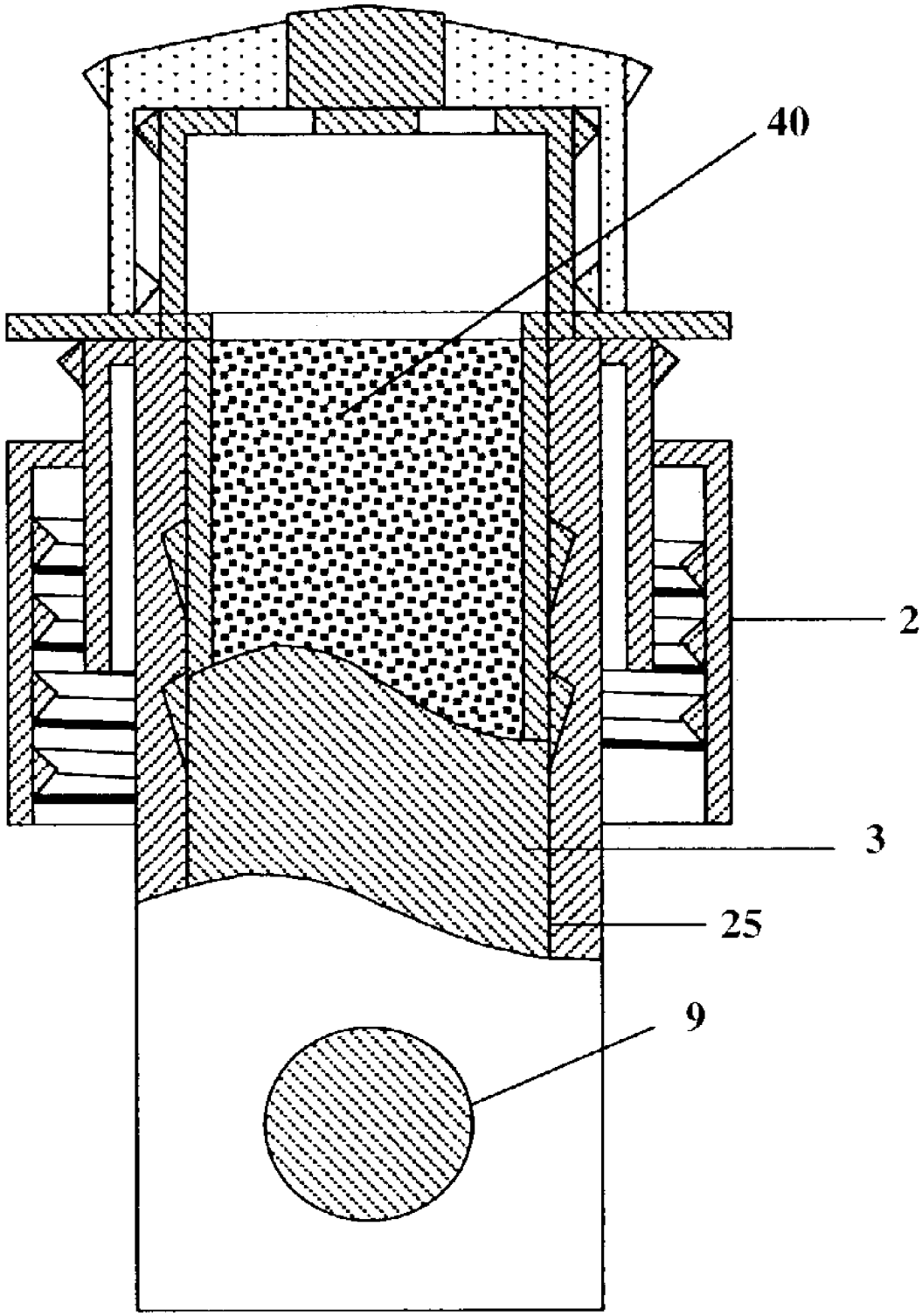
FIG. 2 is a cross-sectional, partial cut-away view of one embodiment of the re-sealable bottle closures of the present invention.
Figure 3:
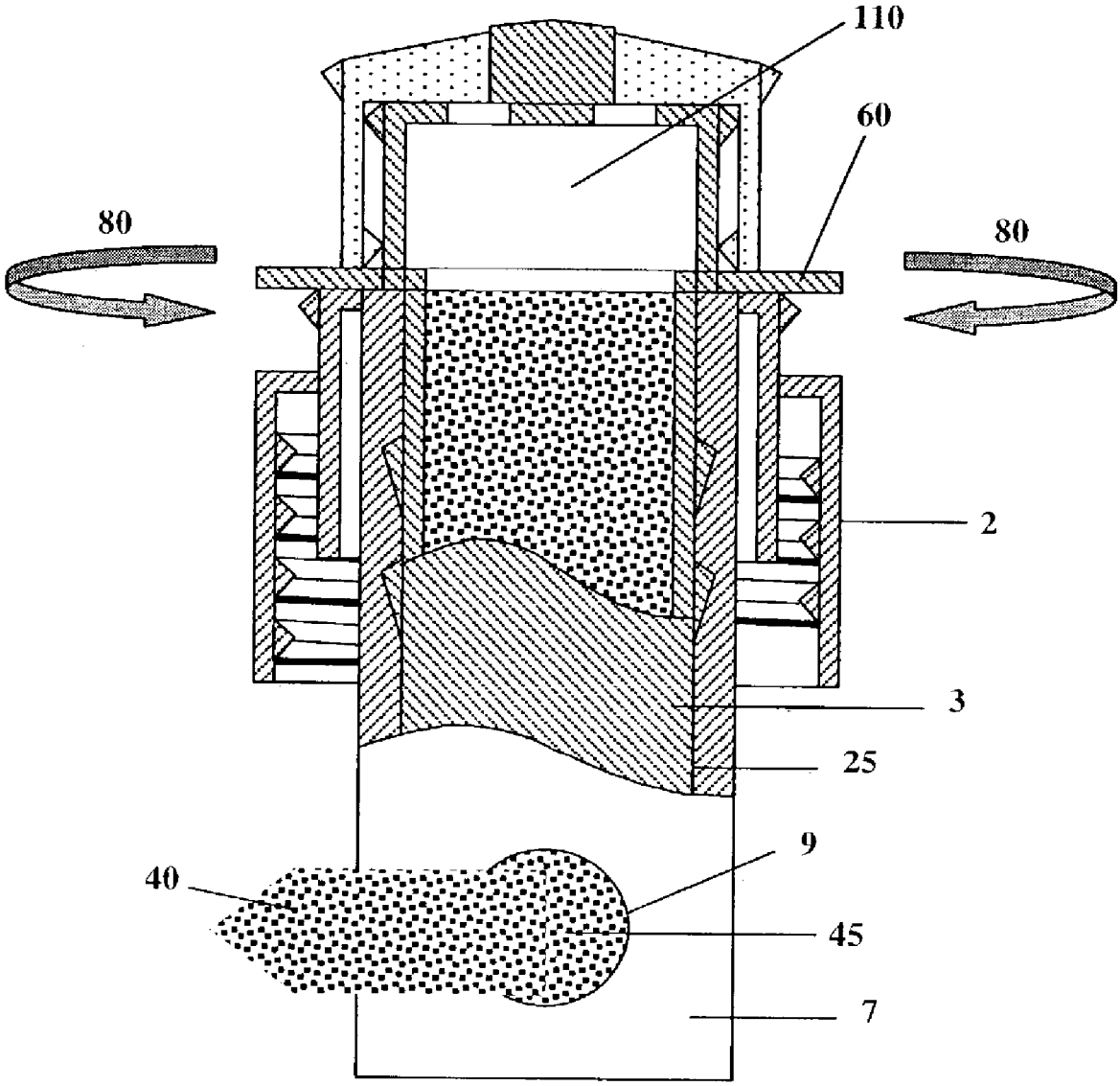
FIG. 3 is a is a cross-sectional, partial cut-away view of the same embodiment of the bottle closures of the present invention as shown in FIG. 2, after activation of the mixing features.

As shown in the cross-sectional, and partial cut-away view in FIGS. 2 and 3, the elongate wall 7 of the circular threaded shell 2 contains an aperture 9. With the mixing mechanism in its closed position, the aperture 45 (not shown in FIG. 2) in the elongate wall 25 of the beverage concentrate reservoir 3 is not visible. As a result the beverage concentrate 40 is not allowed to mix with the beverage bottle contents.

As shown in the partial cross-sectional view in FIG. 3, the mixing mechanism in FIG. 2 has been activated by use of a force, such as through pressure from a consumer's thumb and as shown by arrows 80 on the fin 60 to rotate the beverage concentrate reservoir 3 within the threaded shell 2. With the mixing mechanism in its opened position, the aperture 45, now visible in the elongate wall 25 of the beverage concentrate reservoir 3 and aligned with aperture 9 of the threaded shell 2 allows co-mingling of the beverage concentrate 40 with the beverage bottle contents. Although not required, it is preferred that the beverage concentrate reservoir 3 contain a headspace 110, comprising a greater volume than is required for containing the beverage concentrate 40 alone, which provides additional mixing volume for enhanced ease in mixing the beverage concentrate and the beverage container contents.

Figure 4:
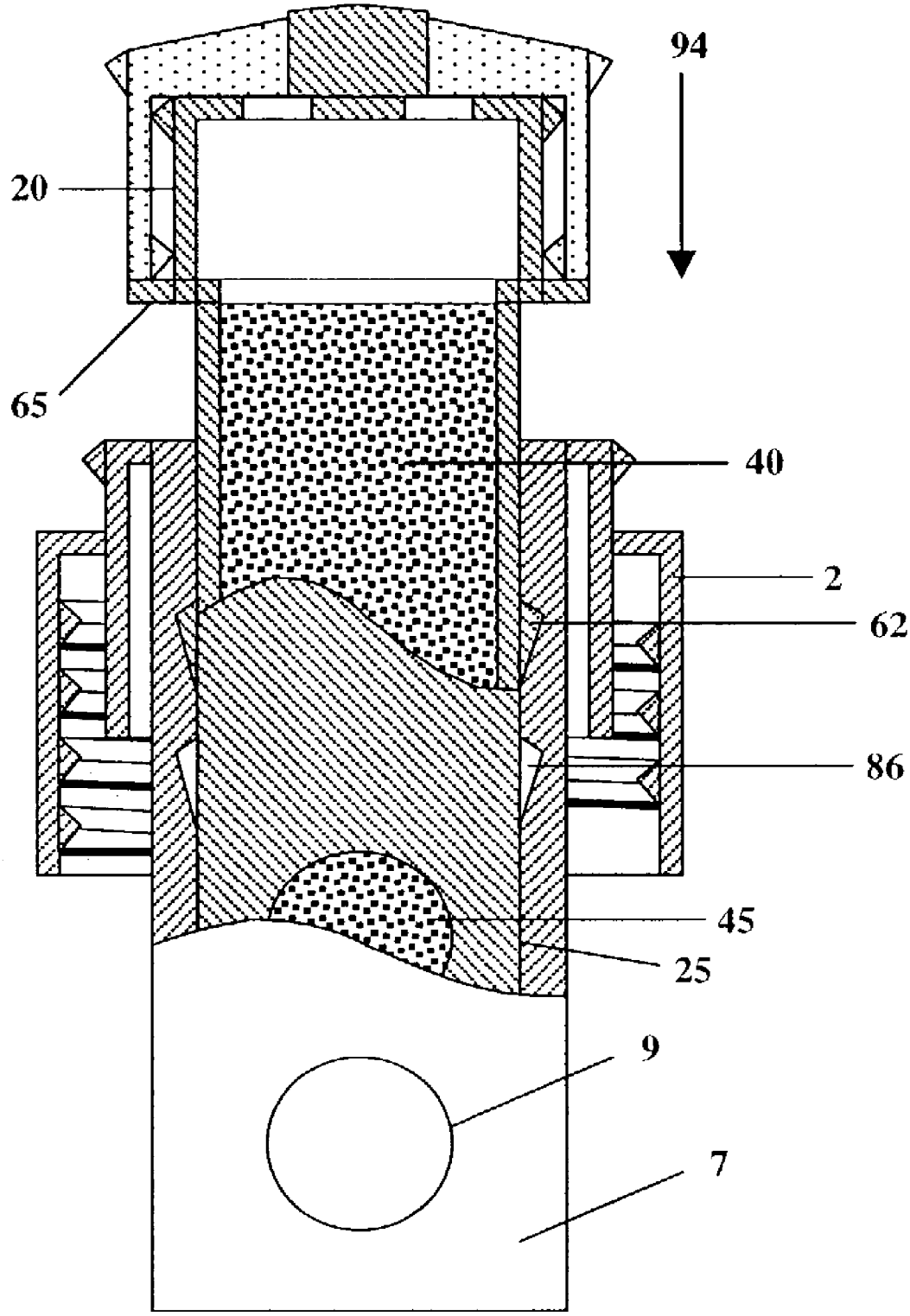
FIG. 4 is a cross-sectional, partial cut-away view of another embodiment of the bottle closures of the present invention.

As shown in the partial cross-sectional view of another embodiment of the present invention in FIG. 4, the elongate wall 25 of the beverage concentrate reservoir 3 contains barb 62 which runs around at least a portion of the circumference of the outer surface of wall 25. The inner surface of elongate wall 7 of the circular threaded shell 2 contains two depressions 85, 86 spaced apart axially along the elongate wall 7 for receiving the barb 62. As shown with the mixing mechanism in closed position in FIG. 4, the beverage concentrate reservoir 3 is partially inserted into the threaded shell 2, and the barb 62 is engaged in the first of the two depressions 85. With the mixing mechanism in its closed position, the aperture 45 (partially shown in cut-away) in the elongate wall 25 of the beverage concentrate reservoir 3 is not visible. As a result the beverage concentrate 40 is not allowed to mix with the beverage bottle contents.

Figure 5:
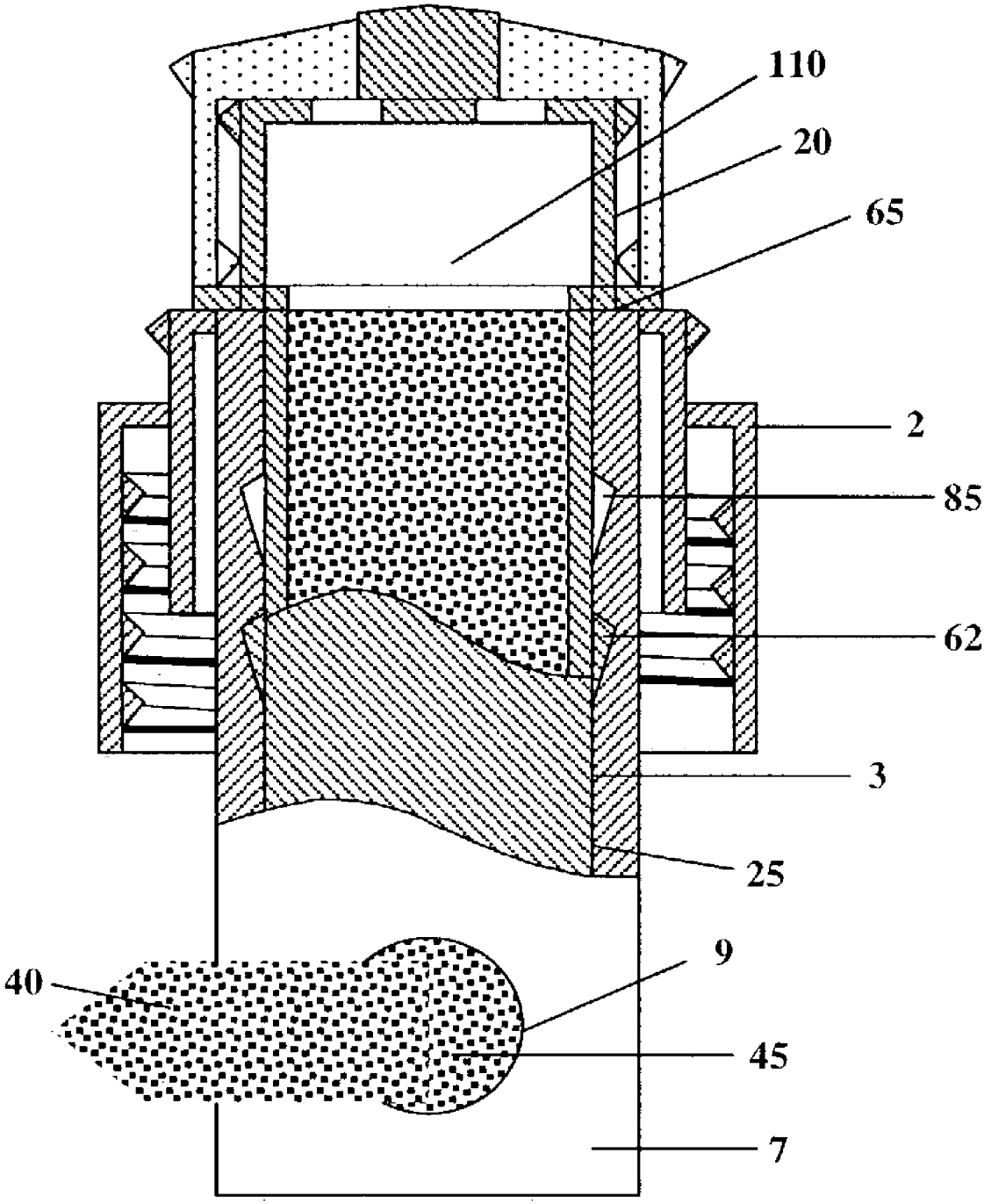
FIG. 5 is a is a cross-sectional, partial cut-away view of the same embodiment of the bottle closures shown in FIG. 4, after activation of the mixing features.

As shown in the partial cross-sectional view in FIG. 5, the mixing mechanism in FIG. 4 has been activated by use of a force as shown by arrows 94 on the top of the dispensing portion 20 of the beverage concentrate reservoir 3 and cap 4 to slide the beverage concentrate reservoir 3 deeper within the threaded shell 2 until the shoulder 65 of the beverage concentrate reservoir 3 contacts the threaded shell 2 and the barb 62 releases from depression 85 along the inner surface of elongate wall 7, and engages lower depression 86. With the mixing mechanism in its opened position, the aperture 45, now visible in the elongate wall 25 of the beverage concentrate reservoir 3 and aligned with aperture 9 of the threaded shell 2 allows co-mingling of the beverage concentrate 40 with the beverage bottle contents. Although not required, it is preferred that the beverage concentrate reservoir 3 contain a headspace 110, comprising a greater volume than is required for containing the beverage concentrate 40 alone, which provides additional mixing volume for enhanced ease in mixing the beverage concentrate and the beverage container contents.

Figure 6:
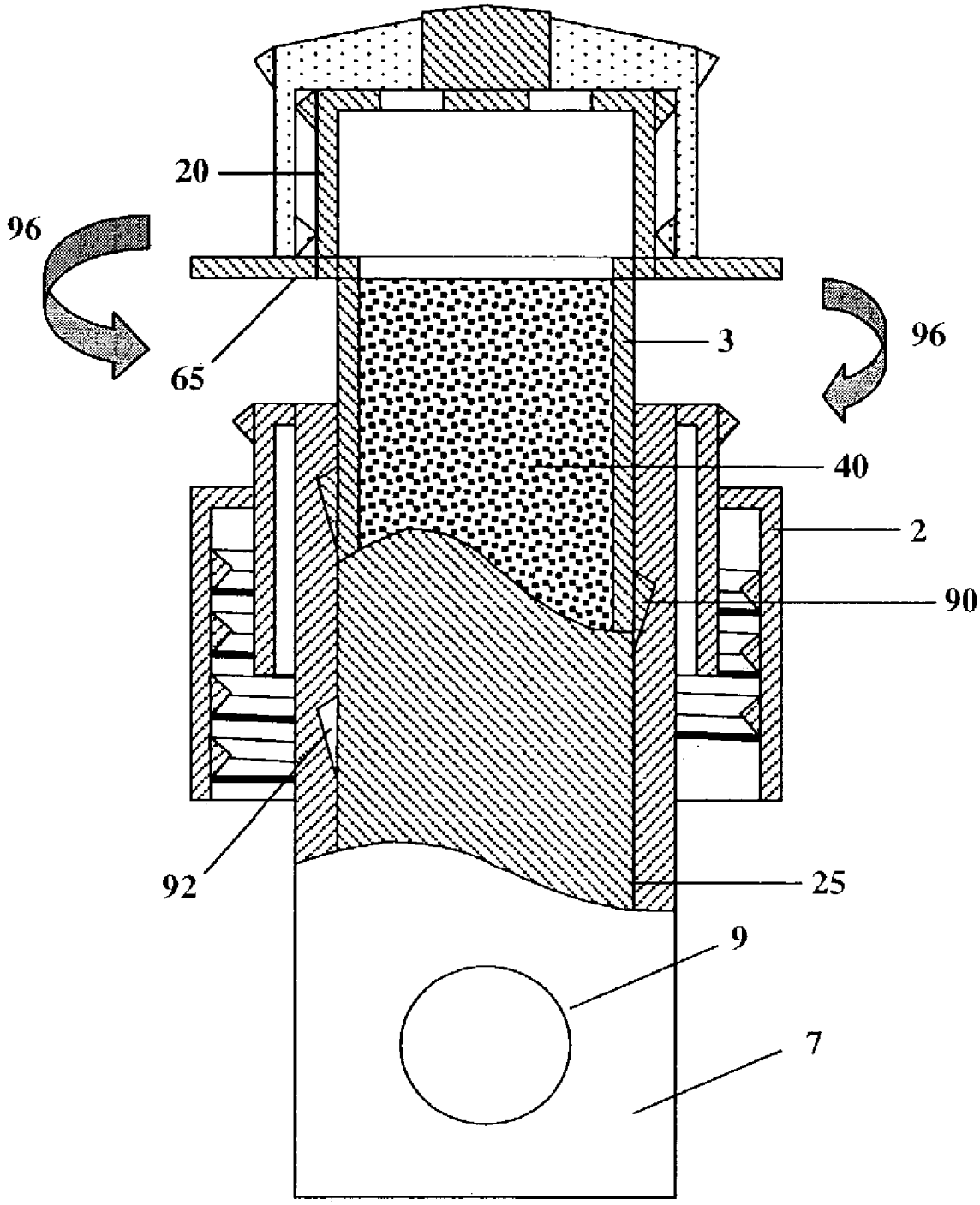
FIG. 6 is a cross-sectional, partial cut-away view of another embodiment of the bottle closures of the present invention.

As shown in the partial cross-sectional view of another embodiment of the present invention in FIG. 6, the elongate wall 25 of the beverage concentrate reservoir 3 contains a thread 90 which runs in generally spiral fashion around at least a portion of the circumference of the outer surface of wall 25. The inner surface of elongate wall 7 of the circular threaded shell 2 contains a corresponding generally spiral depression 92 for receiving the thread 90. As shown with the mixing mechanism in closed position in FIG. 6, the beverage concentrate reservoir 3 is partially inserted into the threaded shell 2, and the thread 90 is engaged in the upper portion of the spiral depression 92. With the mixing mechanism in its closed position, the aperture 45 in the elongate wall 25 of the beverage concentrate reservoir 3 is not visible. As a result the beverage concentrate 40 is not allowed to mix with the beverage bottle contents.

Figure 7:
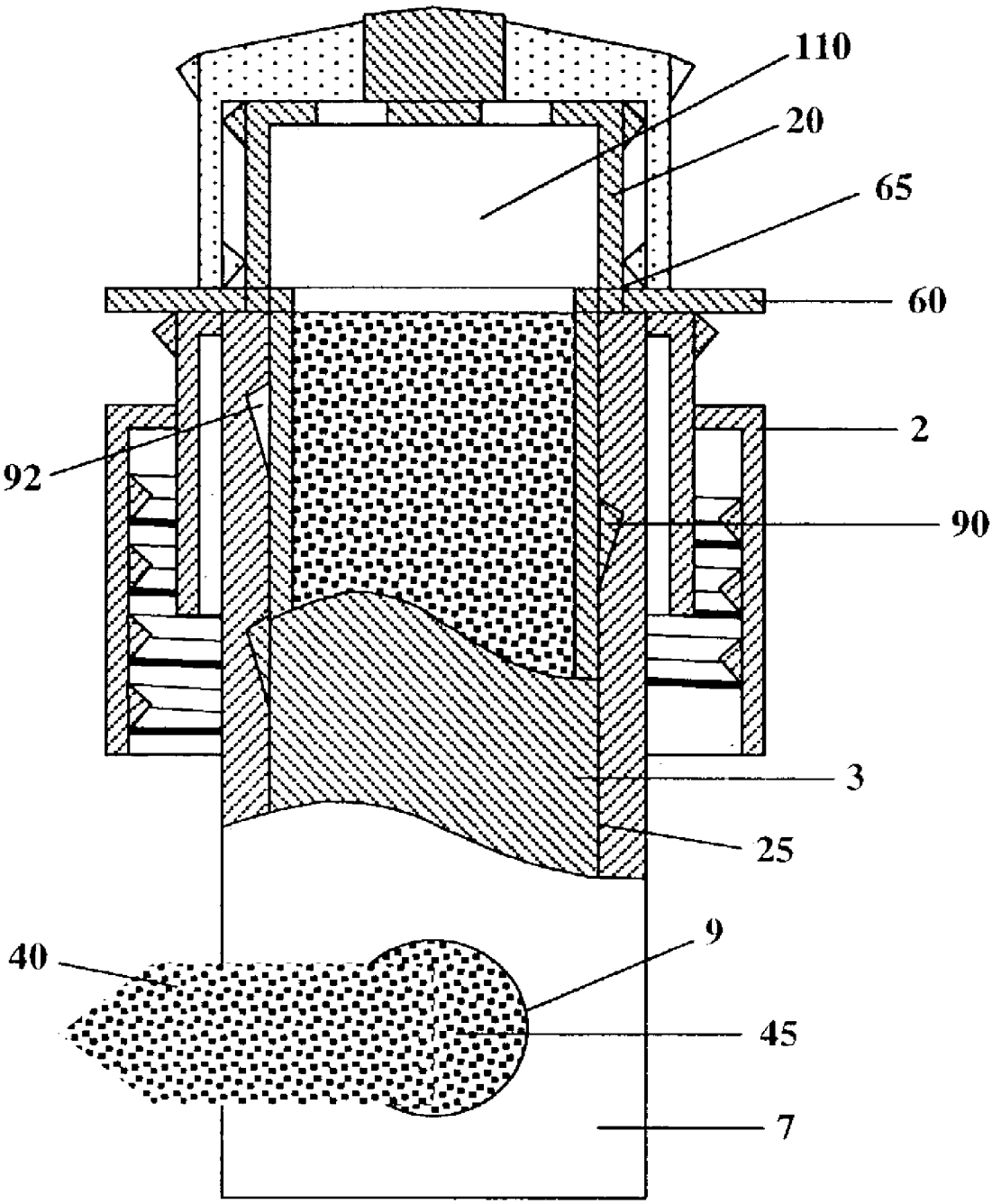
FIG. 7 is a is a cross-sectional, partial cut-away view of the same embodiment of the bottle closures shown in FIG. 6, after activation of the mixing features.

As shown in the partial cross-sectional view in FIG. 7, the mixing mechanism in FIG. 6 has been activated by use of a force, such as through pressure from a consumer's thumb and as shown by arrows 96 on the fin 60 to rotate the beverage concentrate reservoir 3 within the threaded shell 2, causing the thread 90 to bear along the depressions 92, and become further inserted in the threaded shell 2 until the beverage concentrate reservoir 3 engages the shoulder 65 of the threaded shell 2. With the mixing mechanism in its opened position, the aperture 45, now visible in the elongate wall 25 of the beverage concentrate reservoir 3 and aligned with aperture 9 of the threaded shell 2 allows co-mingling of the beverage concentrate 40 with the beverage bottle contents. Although not required, it is preferred that the beverage concentrate reservoir 3 contain a headspace 110, comprising a greater volume than is required for containing the beverage concentrate 40 alone, which provides additional mixing volume for enhanced ease in mixing the beverage concentrate and the beverage container contents.

The incorporation of features which control flow of the mixed beverage upon being dispensed from the beverage container is an important aspect of the invention. As shown in the partial cross-sectional view in FIG. 8, the cap 4 is opened to allow flow of liquid from the beverage container and through flow restricting apertures 55, and aperture 100. Cap 4 is opened by application of a force such as through pressure from a consumer's thumb and as shown by arrows 98 on the sides of cap 4, causing it to slide upward from the dispensing portion 20 of beverage concentrate reservoir 3 and to disengage stem 50. The axial movement of the cap 4 relative to the stem 50 is limited in one direction by the shoulder 65 formed by the walls of the dispensing portion 20 of the beverage concentrate reservoir 3. The axial movement of the cap 4 relative to the stem 50 is limited in the other direction by the bead 70 of cap 4, and the opposed bead 75 located on the walls of the dispensing portion 20 of the beverage concentrate reservoir 3.

Figure 9:
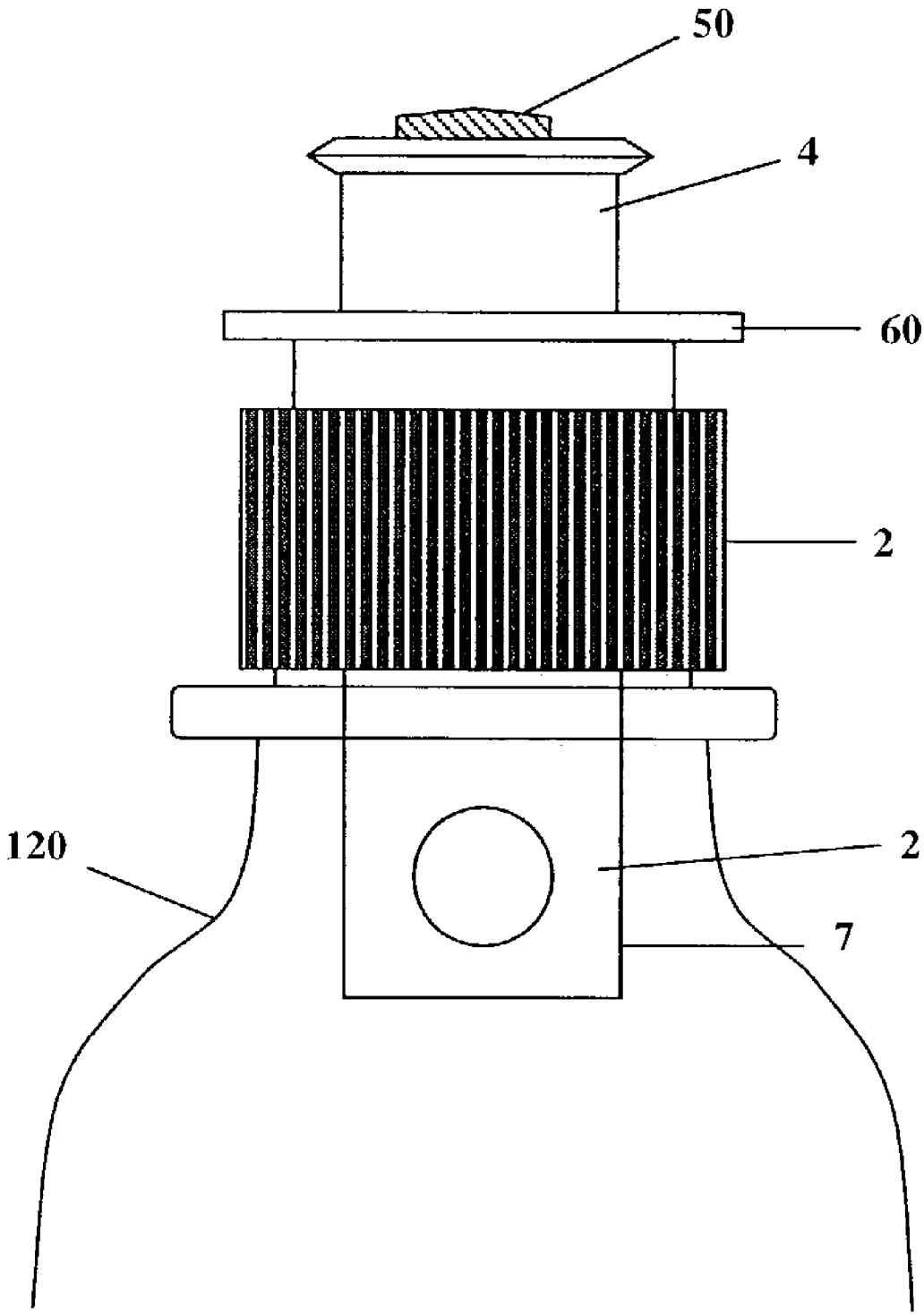
FIG. 9 is a side view of one embodiment of the bottle closures of the present invention, as inserted and threaded onto the neck of a beverage container.

As shown in the side view in FIG. 9, re-sealable bottle closure according to the present invention is threaded on to a water bottle 120. The threaded shell 2 containing the beverage concentrate reservoir in the throat portion 7 can be seen extending down through the neck of the water bottle 120. The fin 60 extending outwardly from the beverage concentrate reservoir for activating the mixing mechanism is visible. Also visible, are stem 50 extending through cap 4.

One advantage of the present invention is that it can be easily manufactured with known techniques, such as plastic molding, used in the manufacture of bottle closures.

Another advantage of the present invention is that the three components, the cap, the beverage concentrate reservoir, and the threaded shell remain together before and during use, so as not to create refuse for disposal prior to disposal of the beverage container.

Another advantage of the present invention is its light weight and small size when compared to a bottled beverage. A consumer can easily carry a number of the re-sealable bottle closures on their person to a point of consumption without significant burden. A unique feature of the present invention is that the re-sealable bottle closure is compatible with, and can be used by a consumer, on demand, in conjunction with almost any bottled beverage, particularly bottled water, to create a mixed beverage.

Yet another advantage of the present invention is that it allows the user to mix a pre-measured amount of beverage concentrate with a liquid, such as water, in a beverage container without having to come into contact with either the beverage concentrate or the beverage container contents.

Figure 10:
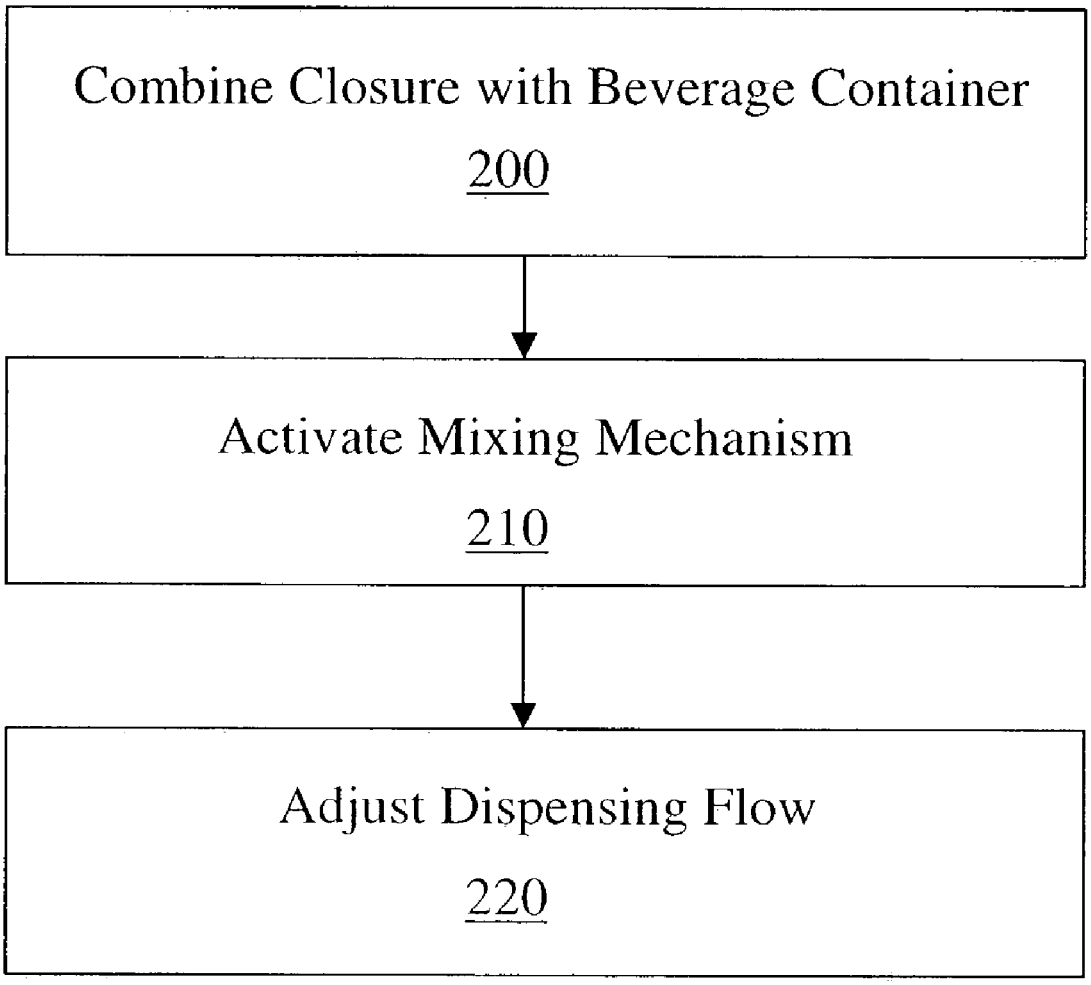
FIG. 10 is a flow diagram of the methods of the present invention.

The methods for using the re-sealable, controlled flow bottle closures of the present invention are described more fully with respect to FIG. 10. Such methods include taking a sealed bottled beverage, such as water, which can be purchased from a vendor at or near a point of consumption, and removing the container's original closure. After the beverage container is opened, a re-sealable bottle closure of the present invention is inserted into the neck of the beverage container and threaded, or snap-fit depending upon the attachment mechanism, to the exposed threads on the beverage container 200. Once sealed in this manner, the mixing mechanism can be activated by the user, allowing the components to co-mingle and mix together to create a mixed beverage 210. Because mixing occurs within the sealed bottle, the consumer does not come into contact with either the beverage concentrate or the beverage container contents until it is desired to dispense them. As a further step for consuming the mixed beverage, the consumer can open the bottle closure by adjusting the cap axially along the stem, allowing the beverage contents to be dispensed in a controlled fashion 220. If desired, the beverage container can be re-sealed for later repeated use by the consumer by resealing the cap on the stem.

The foregoing description of the invention has been presented for purposes of illustration and description. Further, the description is not intended to limit the invention to the form disclosed herein. Consequently, variations and modifications commensurate with the above teachings, and the skill or knowledge in the relevant art, are within the scope of the present invention. The embodiment described hereinabove is further intended to explain modes for practicing the invention and to enable others skilled in the art to utilize the invention in various embodiments and with various modifications required by their particular applications or uses of the invention. It is intended that the appended claims be construed to include alternate embodiments to the extent permitted by the prior art.

What is claimed is:

1. A re-sealable, controlled flow bottle closure comprising:

a threaded shell, a beverage concentrate reservoir, and a cap;

said threaded shell having a throat portion and a container connector portion, said throat portion having an elongate wall connected at one end to said container connector portion, and which forms an interior space, said elongate wall having a mixing aperture near the other end of said elongate wall;

said beverage concentrate reservoir having a mixing mechanism, a tubular dispensing portion and a tubular reservoir portion, said tubular dispensing portion having two ends, said tubular dispensing portion connected at one of said ends to said tubular reservoir portion, and having a closed end, said tubular dispensing portion further having a dispensing aperture in said dosed end and a stem extending from said dosed end;

said tubular reservoir portion having two ends, said tubular reservoir portion connected at one end to said dispensing portion, and having a dosed end to create an interior space, said interior space containing a beverage concentrate, and said tubular reservoir portion further having a mixing aperture near said closed end;

said cap having an aperture, wherein said cap is seated over at least a portion of said tubular dispensing portion of said beverage concentrate reservoir such that when in closed position the stem extending from said closed end of said tubular dispensing portion extends at least partially through said aperture of said cap, sealably engaging said tubular dispensing portion and covering said dispensing aperture in said tubular dispensing portion; and wherein said tubular reservoir portion of said beverage concentrate reservoir is located at least partially within the interior space of said throat portion of said threaded shell, such that after activation of said mixing mechanism said mixing aperture in said tubular reservoir portion is at least partially aligned with said mixing aperture in said elongate wall of said throat portion of said threaded shell.

2. The device as claimed in claim 1, wherein said tubular reservoir portion of said beverage concentrate reservoir is movably engaged with said interior space defined by said elongate wall of said throat portion of said threaded shell, and wherein said mixing mechanism comprises at least one protrusion extending outwardly from said tubular reservoir portion, and said elongate wall of said threaded shell comprises at least one depression for receiving said protrusion of said tubular reservoir portion, and wherein said tubular reservoir portion has a circumference, and wherein said protrusion extends around at least a portion of the circumference of said tubular reservoir portion such that when said protrusion is engaged in said depression, said tubular reservoir portion is capable of being rotated relative to said elongate wall of said threaded shell.

3. The device as claimed in claim 1, wherein said tubular reservoir portion of said beverage concentrate reservoir is movably engaged with said interior space defined by said elongate wall of said throat portion of said threaded shell, and wherein said mixing mechanism comprises at least one protrusion extending outwardly from said tubular reservoir portion, and said elongate wall of said Threaded shell comprises at least one depression for receiving said protrusion of said tubular reservoir portion, and wherein said tubular reservoir portion has a circumference, and wherein said protrusion comprises a screw thread that extends around at least a portion of the circumference of said tubular reservoir portion such that when said protrusion is engaged in said depression said tubular reservoir portion is capable of being rotated in a screw-like manner relative to said elongate wall of said threaded shell.

4. The device as claimed in claim 1, wherein said tubular reservoir portion of said beverage concentrate reservoir is movably engaged with said interior space defined by said elongate wall of said throat portion of said threaded shell, and wherein said mixing mechanism comprises at least one protrusion extending outwardly from said tubular reservoir portion, and said elongate wall of said threaded shell comprises at least two depressions axially spaced apart from one another along said elongate wall for receiving said protrusion of said tubular reservoir portion, such that said protrusion is capable of being interchangeably engaged with said two depressions by application of an axial force on said beverage concentrate reservoir.

5. The device as claimed in claim 4, wherein said tubular reservoir portion has a circumference, and wherein said protrusion extends around at least a portion of the circumference of said tubular reservoir portion such that said tubular reservoir portion can be rotated relative to said elongate wall of said threaded shell.

6. The device as claimed in claim 2, wherein said mixing mechanism comprises a second protrusion extending outwardly from said tubular reservoir portion, and said elongate wall of said threaded shell comprises a second depression for receiving said second protrusion of said tubular reservoir portion, such that said second protrusion is capable of being engaged with said second depression to fix the position of said tubular reservoir portion relative to said elongate wall after activation of said mixing mechanism.

7. A re-sealable, controlled flow bottle closure comprising:

a threaded shell, a beverage concentrate reservoir, and a cap;

said threaded shell having a throat portion and a container connector portion, said throat portion having an elongate wall connected at one end to said container connector portion, and which forms an interior space;

said beverage concentrate reservoir including a beverage concentrate, said beverage concentrate reservoir movably engaged within said interior space of said throat portion and having a tubular dispensing portion, said tubular dispensing portion having two ends, one of said ends of said tubular dispensing portion having a dispensing aperture in said end and having a stem extending outwardly therefrom; and said cap having an aperture, wherein said cap is seated over at least a portion of said tubular dispensing portion of said beverage concentrate reservoir such that when in closed position, said stem extending from said end of said tubular dispensing portion extends through at least a portion of said aperture of said cap, sealably engaging said tubular dispensing portion and covering said dispensing aperture in said tubular dispensing portion.

8. The device as claimed in claim 7, wherein said beverage concentrate reservoir includes a mixing mechanism.

9. The device as claimed in claim 7, wherein said beverage concentrate comprises a solid form of beverage concentrate.

10. The device as claimed in claim 7, wherein said beverage concentrate comprises a liquid form of beverage concentrate.

11. The device as claimed in claim 7, wherein said beverage concentrate comprises a nutritional supplement.

12. The device as claimed in claim 8, wherein said mixing mechanism is capable of being activated by application of a twisting force.

13. The device as claimed in claim 8, wherein said mixing mechanism is capable of being activated by screw action.

14. The device as claimed in claim 8, wherein said mixing mechanism is capable of being activated by application of a pushing force.

15. The device as claimed in claim 8, wherein said mixing mechanism is capable of being activated by application of a pushing force followed by application of a twisting force.

* * * * *